US008434891B1

(12) United States Patent
Ham

(10) Patent No.: US 8,434,891 B1
(45) Date of Patent: May 7, 2013

(54) LED REPLACEMENT LAMP WITH FLUORESCENT TUBES

(76) Inventor: Byung Il Ham, Rancho Palos Verdes, CA (US)

( * ) Notice: Subject to any disclaimer, the term of this patent is extended or adjusted under 35 U.S.C. 154(b) by 0 days.

(21) Appl. No.: 13/305,664

(22) Filed: Nov. 28, 2011

(51) Int. Cl.
*F21V 29/00* (2006.01)

(52) U.S. Cl.
USPC ..... 362/218; 362/222; 362/249.02

(58) Field of Classification Search ..... 362/218, 362/221, 222, 223, 649, 249.02
See application file for complete search history.

(56) References Cited

U.S. PATENT DOCUMENTS 8,262,249 B2 * 9/2012 Hsia et al. ..... 362/217.1
2008/0037245 A1 * 2/2008 Chan ..... 362/218

* cited by examiner

*Primary Examiner* — David V Bruce
(74) *Attorney, Agent, or Firm* — Cislo & Thomas, LLP

(57) ABSTRACT

An improved LED lamp tube and socket assembly intended for the replacement of fluorescent tube style lamps. The new lamp tube featuring a 3-pin end interface wherein a middle or center pin is connected to the LED tube's heat sink to prevent the potential for electrical fires and/or shocks following a failure event such as the LED array making electrical contact with the heat sink of the LED tube. An alternative embodiment bi-pin version of the invention is also disclosed.

7 Claims, 8 Drawing Sheets

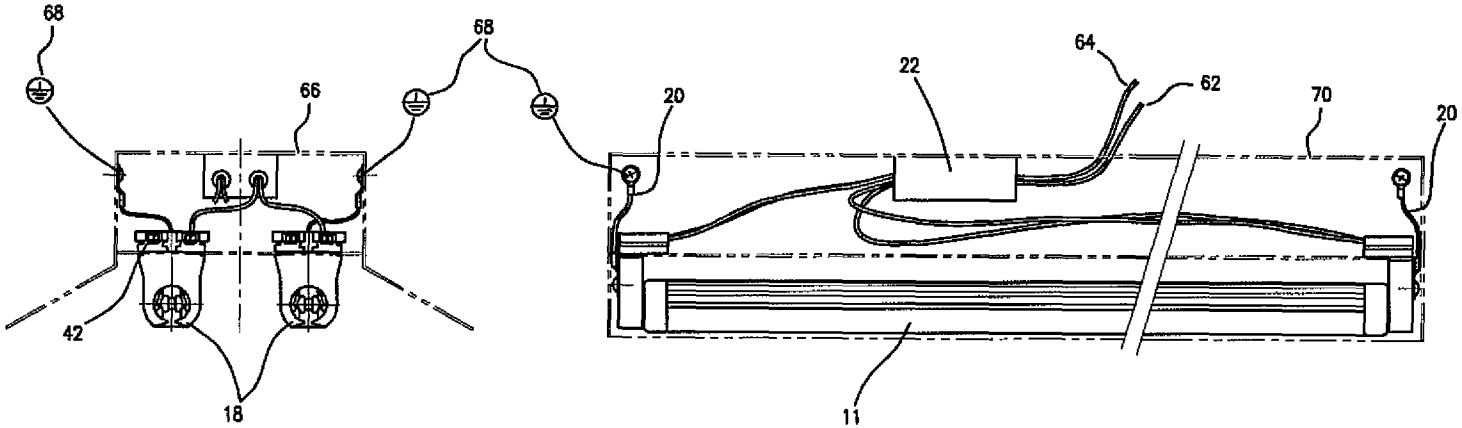
FIG 8
FIG 9
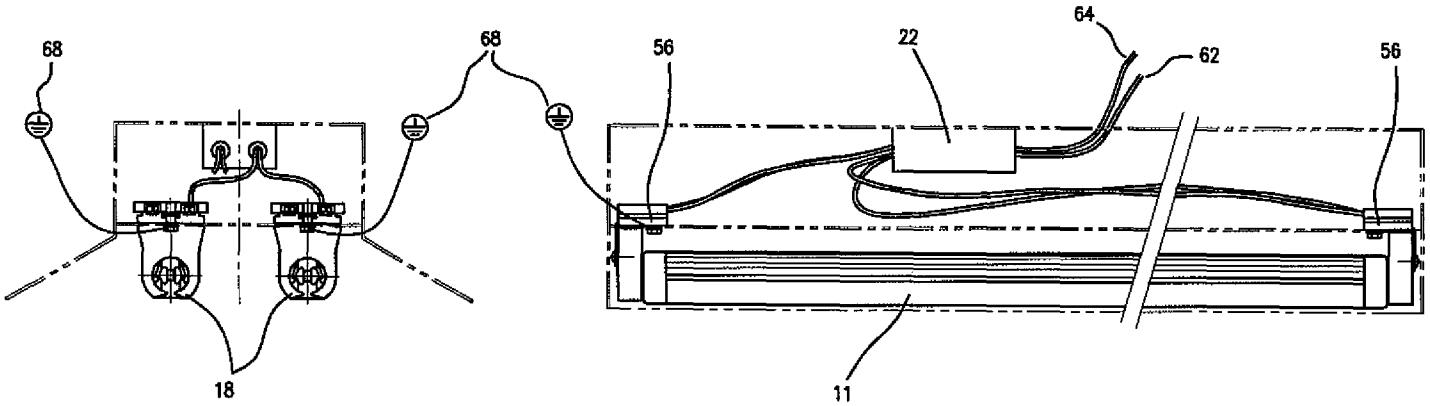
FIG 10
FIG 11

LED REPLACEMENT LAMP WITH FLUORESCENT TUBES

FIELD OF THE INVENTION

The invention relates to improved LED lamps and, in particular, to LED tube lamps which have one or more LEDs as light sources and which can replace a fluorescent tube.

BACKGROUND OF THE INVENTION

Fluorescent lamps are widely used in different environments, such as in homes, offices and industry. Fluorescent lamps are more durable, economical and efficient than incandescent lamps, in which most of the electric power generates heat rather than light. In a conventional fluorescent lamp, the body is a straight tube with a length of about 20 to 60 inches. Fluorescent tubes are low-pressure mercury discharge lamps in which the inner surface of the tube is coated with a fluorescent material. The structure of a fluorescent tube is very simple which has likely contributed to their use for several decades. The lamp consists of an airtight glass tube containing a small amount of mercury, an inert gas, a fluorescent coating such as phosphor, as well as electrodes and a filament at each end of the lamp. At each end of the fluorescent tube, there is a cap with two symmetrically positioned contact pins, to which the electrodes on each side of the tube are connected. DC power to the fluorescent tube is provided via these contact pins.

In order to provide a florescent tube with DC power an AC to DC power supply is used to convert AC line voltage (typically either 115 or 230 volts) to DC input current. The DC current is reduced by the power supply to a level suitable for use in a florescent tube. These power supplies are generally known within the lamp industry as ballasts.

Unlike incandescent or newer light emitting diode ("LED") lamps, fluorescent lamps will not illuminate or start simply by applying power to the lamp. The lamp requires a starting circuit. The circuit for a fluorescent tube lamp comprises a power supply (ballast) and a starter (capacitor or other switching device). Upon turning on a fluorescent lamp, the resistance through the tube is very high, and the electric current passes through the ballast, the electrodes on one side of the tube and a closed starter circuit. When passing through the electrodes, the current heats the filament, causing it to emit electrons which ionize the gas inside the tube. The ionized gas forms a current path through the tube. When, after a moment, the starter opens, a high voltage spike occurs between the electrodes which causes current conduction through the ionized gas in the fluorescent tube and thus switches on the lamp. Many types of starters are known in the art.

Lighting systems based on LED light sources are a fairly new technology in the lighting field. LED's are desirable because they have substantially longer life and they use far less power than fluorescent tubes of equivalent output. LED replacement tubes for fluorescent lamps are of the same length and diameter of the fluorescent lamp they are intended to replace. LED replacement tubes typically comprise a number of LEDs to produce the desired light. The LEDs are disposed between a heat sink and a clear or translucent cover. The LEDs may be in a series or parallel circuit array. LEDs differ from fluorescent tubes in that only a power supply or ballast capable of converting high voltage AC line current to a relatively lower voltage DC input current to the LEDs is required. No starting circuit is required with LED lamps.

In some types of LED tube lamps, the ballast is built into the lamp. In others, an external ballast is used. As LEDs have become more powerful and continue to gain in wattage, the need has become more critical to dissipate the heat generated by the LEDs. Therefore, in a typical LED tube used for replacing a fluorescent tube approximately ½ of the circumference of the LED tube comprises a metallic heatsink while the other half is clear or translucent for the transmission of light. The LED arrays are thermally, but not electrically, connected to the metallic heat sink.

Government safety regulations require that lighting fixtures be constructed in such a way that when a fluorescent or LED tube is replaced, it is impossible for a user to come into contact with any parts at input voltage even if the lighting fixture were connected to line voltage. With fluorescent tubes, this requirement is met even if a fluorescent tube is replaced in such a way that only one set of contacts is in a tube end connector and a user touches the contacts on the side of the tube during installation. This requirement is met because even though input voltage may be present at the contacts, no current passes through the gas-filled fluorescent tube before the gas in the tube is ionized with a starting pulse. In other words, the gas in the fluorescent tube serves as an insulator in itself. The electric circuit of the fluorescent tube lighting fixture is such that generation of a starting pulse requires that both ends of the tube be connected to the contacts of the tube holder.

The above however, is not true in the case of LED lights. In LED lights current conduction occurs through the tube at any time that one set of contacts is connected to input voltage. To solve this problem, manufacturers of LED tubes have equipped the lights with electronic switches where the switch opens and breaks the electrical circuit when voltage is detected at only one set of contacts. When voltage is detected at both sets of contacts, the switch closes and allows current to flow.

In the present invention, the inventor has recognized that the safety features presently provided by manufacturers of LED tube lamps are inadequate because the metallic heat sink of the tube is not grounded. Under certain failure conditions, the LED arrays could inadvertently make electrical contact with the metallic heat sink causing a short circuit and a potential fire hazard.

SUMMARY OF THE INVENTION

As discussed above, under certain failure conditions, input voltage or line voltage could inadvertently be applied to the metal heat sink of an LED tube style lamp causing a short circuit and a potential fire hazard because in such circumstances the printed circuit board and other electrical components within the tube can quickly overheat and catch fire.

This failure condition may arise under several scenarios. For example, over time, the thermal insulation which thermally connects the LEDs with the heat sink may break down and allow an electrical connection to occur between the lamp the heat sink. Overheating of the lamp may accelerate this breakdown. In LED tubes where the ballast is incorporated in the tube, it must be insulated from the heat sink. Here again, the insulating material my break down over time and potentially expose the heat sink to line voltage. Moreover, LED tubes with relatively thin metallic heat sinks and plastic covers may be subject to flexing either during shipping or less than careful installation. Such flexing of the tubes could either break the thermal substrate of the LEDs and thus cause electrical contact with the heat sink or could damage the ballast and associated wiring in such a manner that electrical contact is made with the heat sink.

The present invention solves the aforementioned problems by providing a ground pin on each side cap of the LED tube where the ground pins are connected to the heat sink and via the lamp sockets to an external ground. The grounding may be accomplished by use of tri-pin end caps for the LED tube, i.e. the end caps of the new lamp retain the outermost pins in their typical location as found in typical florescent lamp tubes. A third pin, however, is located in the middle of each end cap and this pin is connected with the ground terminal of the present invention end socket which in turn is connected to an external ground via a ground strap or metal ground lug.

BRIEF DESCRIPTION OF THE DRAWINGS

FIG. 8 shows a left end view of a light fixture, partially cutaway, showing the LED tube lamp, sockets and splitter box of the present invention as installed in the fixture, wherein a ground strap is used to ground the light.

FIG. 9 shows right side view of a light fixture, partially cutaway, showing the LED tube lamp, sockets and splitter box of the present invention as installed in the fixture, wherein a ground strap is used to ground the light.

FIG. 10 shows a left end view of a light fixture, partially cutaway, showing the LED tube lamp, sockets and splitter box of the present invention as installed in the fixture, wherein a ground lug is used to ground the light.

FIG. 11 shows right side view of a light fixture, partially cutaway, showing the LED tube lamp, sockets and splitter box of the present invention as installed in the fixture, wherein a ground lug is used to ground the light.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
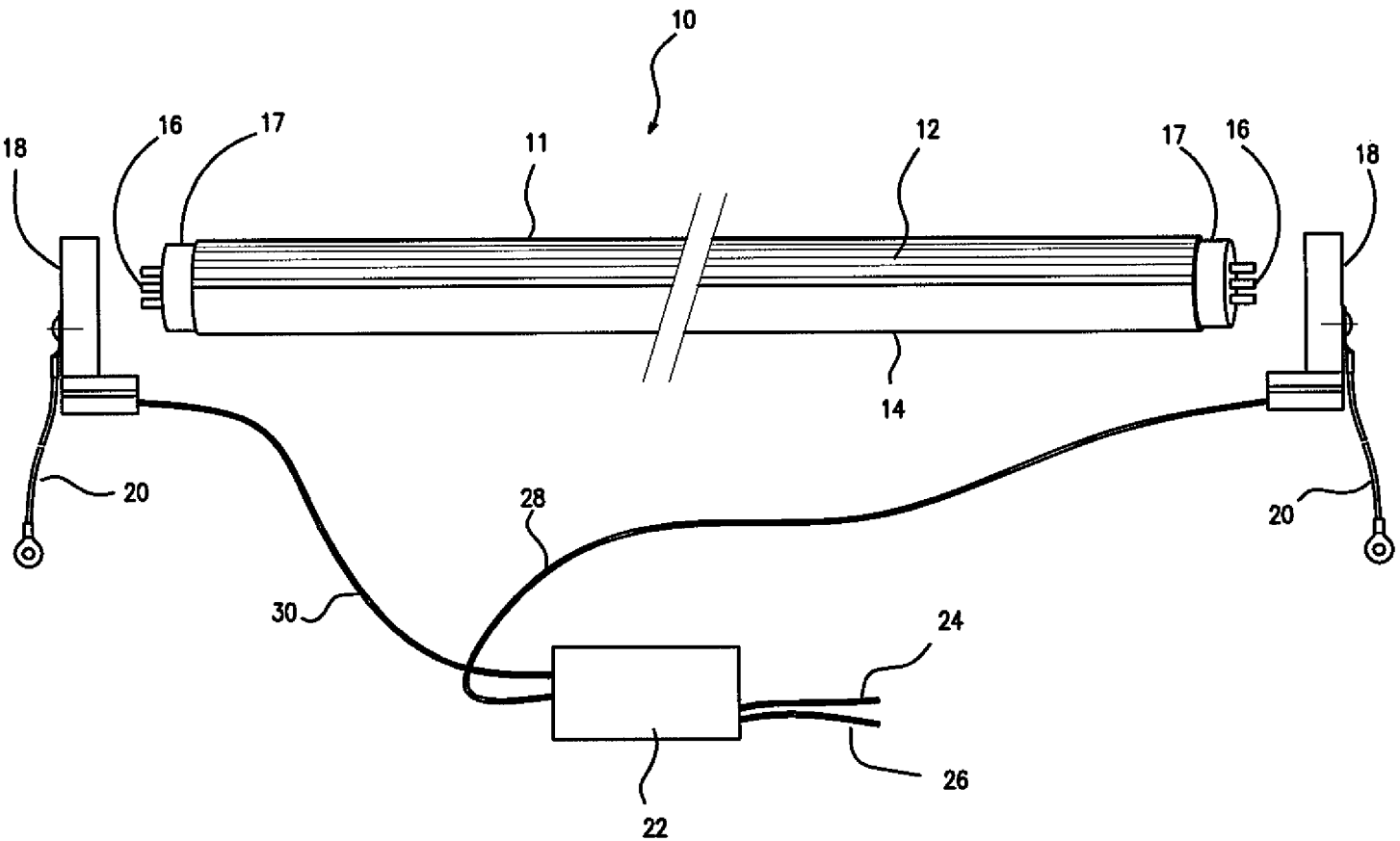
FIG. 1 is a schematic view of an improved tri-pin LED replacement tube for a fluorescent tube and associated tri-pin socket and optional wiring box.
Figure 2:
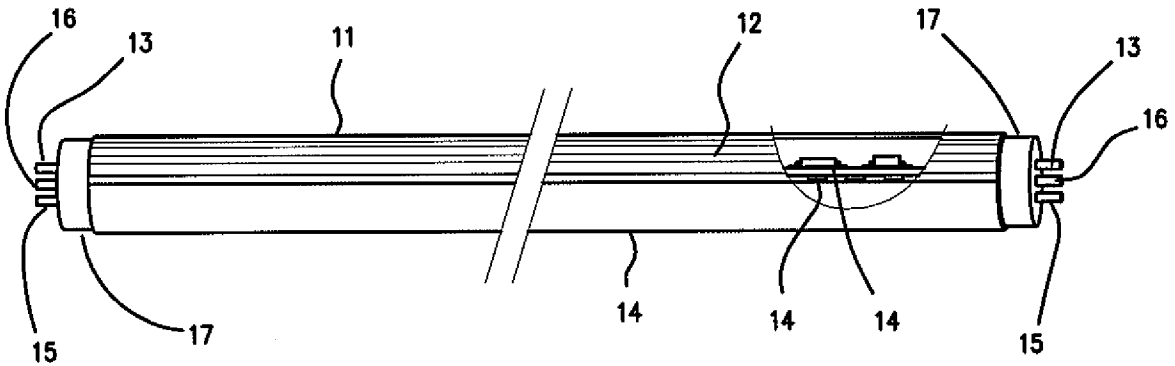
FIG. 2 is a schematic view, partially cutaway, of the improved tri-pin LED replacement tube of FIG. 1.
Figures 3A, 3B, 3C, 3D, 3E:
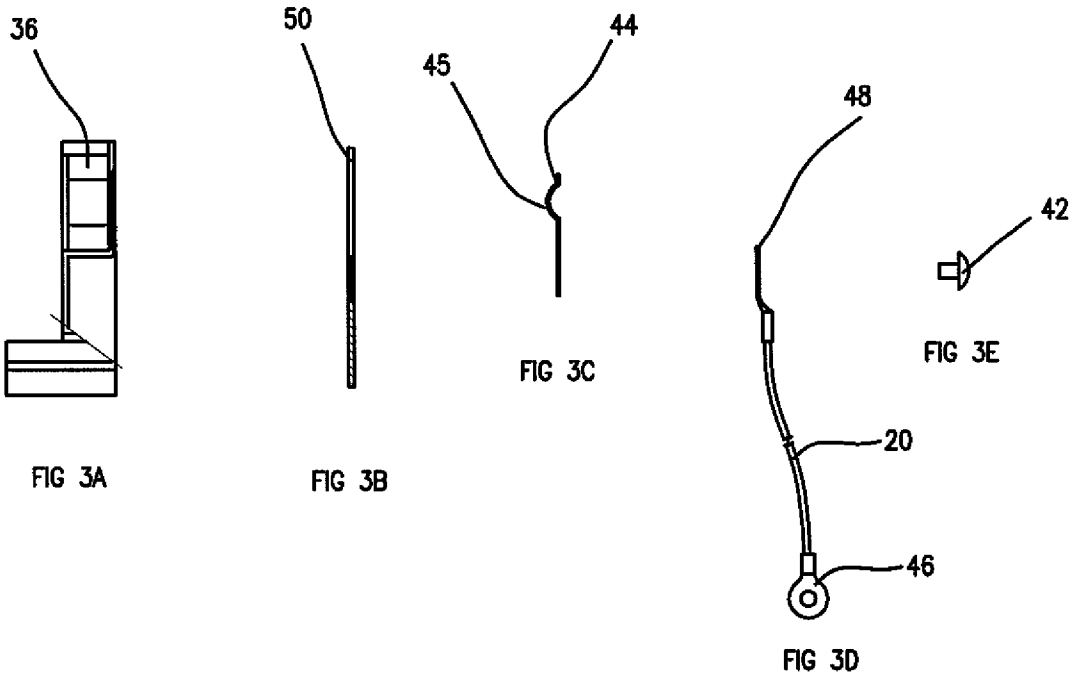
FIG. 3A is a socket body for use with the tri-pin socket shown in FIG. 1.
FIG. 3B is a back cover for use with tri-pin socket shown in FIG. 1.
FIG. 3C is a ground plate for use with the tri-pin socket shown in FIG. 1.
FIG. 3D is ground strap for use with the tri-pin socket shown in FIG. 1.
FIG. 3E is a rivet for use with the tri-pin socket shown in FIG. 1.

The field of the invention comprises all LED tube style lamps. With reference to FIGS. 1 and 2, the present invention improved LED lamp 10 comprises an LED tube style lamp 11 which has a metallic heat 12 sink on a portion of the lamp and a clear or translucent light emitting portion 14. The LED lamp also includes an end cap 17 at each end of the lamp. Each end cap 17 includes three pins rather than the two pins of a conventional fluorescent lap. One pin 13 is a dummy pin which does not carry power and serves only to maintain compatibility with existing fluorescent lamp fixtures. A second pin 15 is a power pin and conducts current through the LED array. The third pin is a ground pin 16 which serves to connect the lamp's heat sink to an external ground. Methods of connecting the ground pin 16 to the lamp's heat sink are known in the art.

With continued reference to FIG. 1, the present invention 10 includes tri-pin tube end sockets 18. The tri-pin end sockets 18 are typically made from a high dielectric strength plastic as is known in the art. Coming off the center of the socket 18 is a ground strap 20. The ground strap is electrically connected with the ground pin 16 when the lamp tube 11 is installed in the sockets. Additional detail regarding the present invention sockets 18 will be provided below.

In LED lamps that use an internal ballast (not shown), it is necessary to run electrical wires carrying full AC line voltage to the internal ballast. Wires that carry full line voltage are generally several gauges larger than the input terminals on industry standard T8 and T5 type end sockets. Therefore, the present invention provides a wiring box 22 where wires 24 and 26 are AC line inputs which, for example, may be of 10 or 12 gauge in size. The wiring box reduces the size of the output wires 28 and 30 to a smaller gauge size, for example 18 or 20 gauge, suitable for use with the input terminals of the tri-pin sockets 18 which are based upon standard bi-pin T5 and T8 socket input terminals 42 (shown in FIGS. 4A and 6A).

Referring now to FIG. 2, in the partial cutaway, LEDs 32 and the LED printed circuit board 34 are shown. Due to their high heat output, the LEDs must be thermally, but not electrically connected, to the heat sink. In any instance where the LEDs come into electrical contact with the heat sink a short circuit in LED array will arise and in the absence of a return ground path, heat may quickly build up in the lamp leading to a hazardous condition such as an electrical fire.

Referring now to FIGS. 3A through 3C and 4A through 4D, the tri-pin end socket 18 of the present invention is a modified version of industry standard bi-pin T5 and T8 type sockets. The end sockets 18 are modified for use with a 3 pin LED tube type lamp of the present invention is shown. With particular reference to FIGS. 3A through 3E, the new tri-pin end socket 18 comprises a socket body 36, a back cover 50 a ground plate 44 a ground strap 20 having ring terminals 46 and 48 and a rivet 42 which connects the ground strap, ground plate and back cover to the socket body.

Figure 4C:
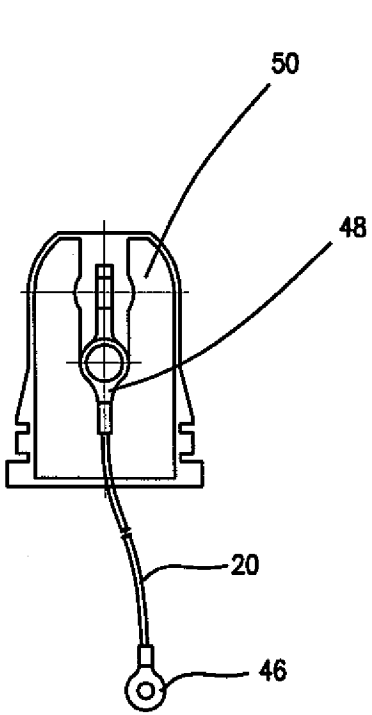
FIG. 4C is a rear view of the tri-pin socket of FIG. 1.
Figure 4B:
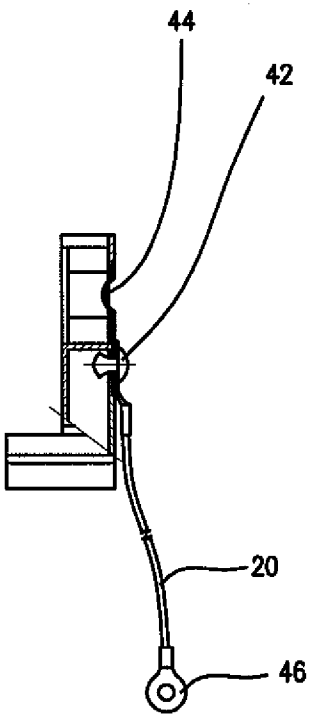
FIG. 4B is a side view of the tri-pin socket of FIG. 1.
Figure 4A:
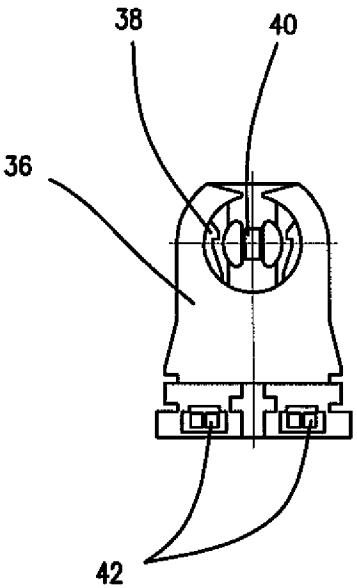
FIG. 4A is a front view of the tri-pin socket of FIG. 1.
Figures 5A, 5B, 5C, 5D, 5E:
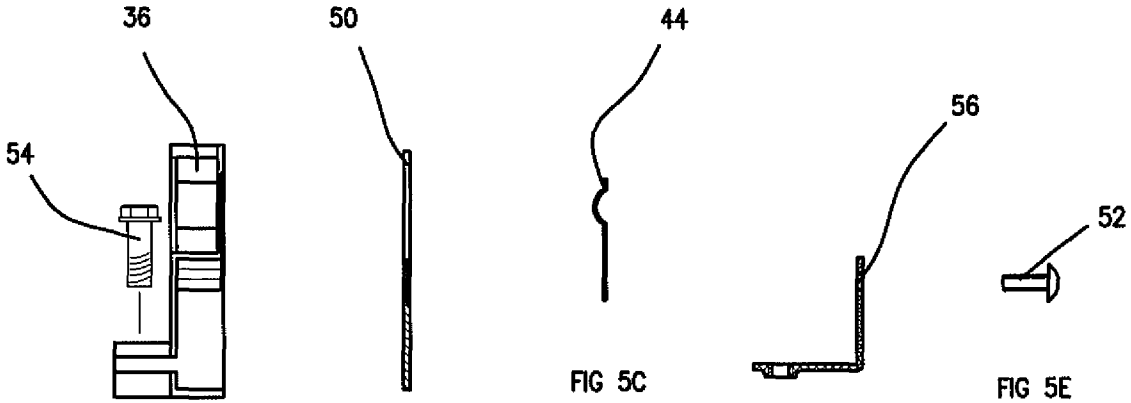
FIG. 5A is a socket body for use with an alternative embodiment of the tri-pin socket shown in FIG. 1.
FIG. 5B is a back cover for use with an alternative embodiment of the tri-pin socket shown in FIG. 1.
FIG. 5C is a ground plate for use with an alternative embodiment of the tri-pin socket shown in FIG. 1.
FIG. 5D is a ground strap for use with an alternative embodiment of the tri-pin socket shown in FIG. 1.
FIG. 5E is a rivet for use with an alternative embodiment of with the tri-pin socket shown in FIG. 1.

Referring now to FIGS. 4A through 4B, front, side and rear views of the present invention tri-pin socket 18 are shown. The new socket functions similarly to older bi-pin sockets in that when a light tube is placed into the socket and rotated the outermost pins are locked into place by hook shaped outer contacts 38. What is different, however, is that in the new tri-pin socket, a ground plate 44 which includes a protruding section 45 is attached to the rear of the socket body 36 so that the ground or middle pin 16 of the lamp 11 makes contact with the ground plate 44. Attached to the ground plate 44 is the ground strap 20 which when in use is attached to an external ground.

With reference to FIGS. 5A through 5E and 5A through 6C, an alternative embodiment of the tri-pin socket 18 is disclosed. In this embodiment of the tri-pin socket 18 an angled ground lug 56 is used in place of the ground strap 20. With particular reference to FIGS. 5A through 5E, this alternative embodiment of the new tri-pin end socket 18 comprises a socket body 36, a back cover 50 a ground plate 44, the ground lug 56, and a screw 52 which threadably connects the ground plate, ground lug, and back cover to the socket body.

Figure 6C:
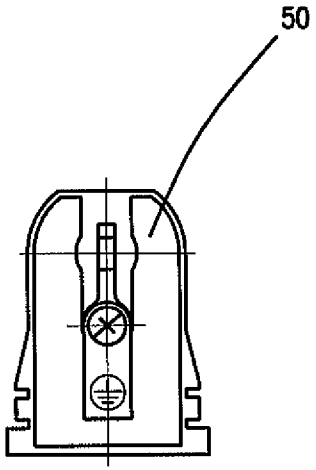
FIG. 6C is a rear view of an alternative embodiment of the tri-pin socket of FIG. 1.
Figure 6B:
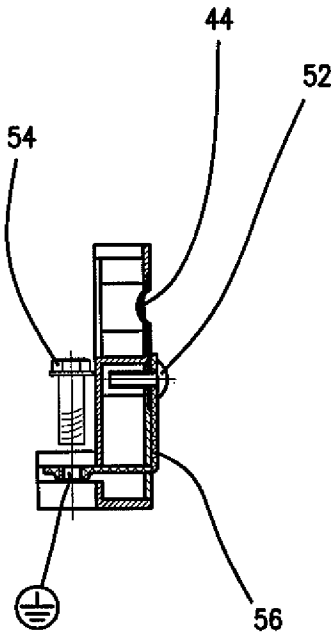
FIG. 6B is a side view of an alternative embodiment of the tri-pin socket of FIG. 1.
Figure 6A:
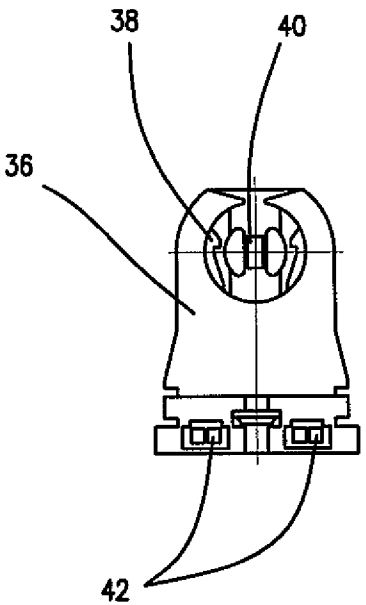
FIG. 6A is a front view of an alternative embodiment of tri-pin socket of FIG. 1.

Referring now to FIGS. 6A through 6B, front, side and rear views of the angled lug embodiment of the present invention tri-pin socket 18 are shown. Like the previous embodiment, the new socket functions similarly to older bi-pin sockets in that when a light tube is placed into the socket and rotated the outermost pins are locked into place by hook shaped outer contacts 38. The difference, however, is that in the new tri-pin socket, a ground plate 44 which includes a protruding section 45 is attached to the rear of the socket body 36 so that the ground or middle pin 16 of the lamp 11 makes contact with the protruding portion 45 of the ground plate 44, when the lamp tube is fully inserted into the socket. In this embodiment of the tri-pin socket 18, the ground plate 44 is attached to the ground lug 56 via screw 52. For those installations where a ground is available immediately under the socket, a ground screw 54 may be used to connect the tri-pin socket 18 to ground.

Figure 7:
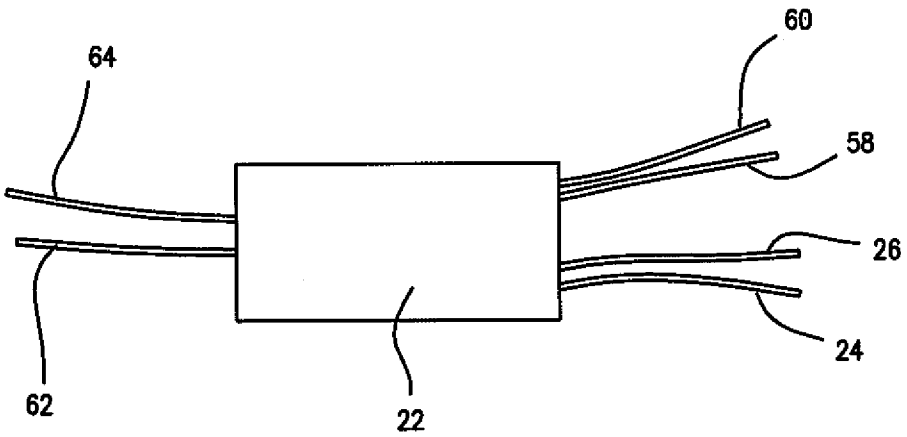
FIG. 7 is an alternative wiring box to the box shown in FIG. 1 and is used when multiple LED tubes are used within the same lighting fixture.

With reference to FIG. 7, another embodiment of the wiring box 22 is shown. In this embodiment, the wiring box provides AC outputs for providing power to two LED tube arrays. The wiring box is used for LED lamp tubes that use an internal ballast (not shown). With an internal ballast, it is necessary to run electrical wires carrying full AC line voltage to the ballast. As mentioned above, wires that carry full AC line voltage (typically either 120 or 230 volts) are generally several gauges larger than the input terminals on industry standard T8 and T5 style end sockets. Therefore, the present invention provides a wiring box 22 where wires 24 and 26 are AC line inputs which, for example, may be of 10 or 12 gauge in size. The wiring box reduces the size of the two pairs of output wires 58 and 60 and 62 and 64 to a smaller gauge size, for example 18 or 20 gauge, suitable for use with the tri-pin sockets 18 which use standard size bi-pin T5 and T8 socket input terminals 42 (shown in FIGS. 4A and 6A). Because the wire runs from the wiring box to the internal ballast of the lamps are relatively short, they are capable of safely carrying line voltage over the short distance needed. Those skilled in the art will readily recognize that the wiring box 22 can be expanded to provide as many output leads as necessary to supply the number of tubes in a lamp array.

In the exemplary embodiment, the tri-pin end sockets 18 are modified industry standard T5/T8 sockets which have standard input terminals requiring relatively small gauge wires. Those skilled in the art however, will understand that custom tri-pin sockets could readily be designed with input terminals capable of accepting a larger size wire gauge than the current standard for T5/T8 sockets.

Referring now to FIGS. 8 and 9, the component parts of the present invention are shown installed in a light fixture 66. The light fixture 66, as shown in the figures, is cable of holding two LED lamp tubes 11. The fixture 66 will typically be made of formed sheet metal such as steel or aluminum or other electrically conductive material, which in addition to holding the LED lamp tubes also provides a ground for the lamps. In the arrangement shown in FIGS. 8 and 9, two T5 or T8 style lamp sockets 18, as modified to accept a third ground pin as taught by the present invention are shown at each end of the lamp fixture 66. Installed within the sockets 18 are two LED lamp tubes 11. The LED lamp tubes 11 are equipped with an internal ballast (not shown) and therefore require that AC line voltage be supplied to the terminals 42 of the lamp sockets 18.

To provide AC line voltage, the splitter box 22 is mounted to the underside of a top surface 70 of the light fixture 66. AC line voltage (typically 120 or 230 volts) is introduced to the splitter box 22 via input leads 62 and 64. These input leads will typically be of 10 to 12 gauge in size in typical household wiring. Since the input terminals 42 of the T5/T8 sockets 18 will typically accept wire gauges in of about 18 to 20 gauge, the splitter box includes an internal interconnection (not shown) which steps down the size of the electrical wiring to a size suitable for use with the sockets 18.

As taught by the exemplary embodiment for the sockets 18 of FIGS. 3A through 4C, grounding of the heat sinks 12 of the LED lamp tubes 11 to the light fixture 66 is accomplished by means of the third ground pins 16 of the LED lamp tubes 11 making contact with the ground plates 44 of the modified T5/T8 sockets 18. Grounding to the light figure is then accomplished by means of the ground straps 20 being attached to the light fixture, typically by means of screws. Thus, in light fixture 66 of FIGS. 9 and 10, four (4) ground straps 20, i.e. one for each socket, are connected to the lamp fixture 66 at four locations on the fixture.

FIGS. 10 and 11 are similar to FIGS. 9 and 10, with the exception that the alternative embodiment of the sockets 18 shown in FIGS. 5A through 6C is used. In this embodiment, grounding of the LED tube lamps is also accomplished by means of the ground pins 16 of the lamp tubes 11 making contact with the ground plates 44 of the modified T5/T8 socket. However, rather than using a ground strap, in the alternative embodiment of the sockets 18, the ground plate 44 is electrically connected with a ground lug 56, which is incorporated in the socket. The heat sinks 12 of the LED lamp tubes 11 may then be grounded to the lamp fixture via a screw which connects the ground lugs 56 to the light fixture 66. Again, each individual socket is grounded to the light fixture.

The foregoing detailed description and appended drawings are intended as a description of the presently preferred embodiments of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A tri-pin LED tube, intended for replacing standard fluorescent tube lights, comprising:

an LED lamp tube including a heat sink portion along a length of the tube which partially covers the circumference of the tube; a translucent portion along a length of the tube which covers the remaining circumference of the tube; an array of LEDs electrically connected inside the tube to a circuit board; the circuit board being thermally connected, but electrically isolated, from the heat sink, and an end cap at each end of the lamp tube;

both end caps of the LED tube being providing with a pair of outermost pins, at least one of the outmost pins being a current carrying pin for providing power to the LED array; and both end caps of the LED tube being provided with a middle pin which is connected to the lamp heat sink; and wherein in the event a failure condition occurs causing electrical current traveling through the LED array to contact the heat sink, such current is safely transferred to ground by at least one of the middle ground pins.

2. A socket assembly for use with the tri-pin LED tube of claim 1, having a pair of outermost pins and a middle or center pin, at least one of the outermost pins being current carrying, and the center pin contacting a ground plate; the ground plate being connected to a ground strap, the ground strap being connectable to ground, and wherein the LED tube is rotatable to a locked position so that the outermost pins contact the outermost contacts, and the middle pin contacts the ground plate.

3. A system for using a tri-pin LED tube light to replace a standard fluorescent tube light, comprising:

an LED lamp tube and mating end sockets;

an LED lamp tube including a heat sink portion along a length of the tube which partially covers the circumference of the tube; a translucent portion along a length of the tube which covers the remaining circumference of the tube; an array of LEDs electrically connected inside the tube to a circuit board; the circuit board being thermally connected, but electrically isolated, from the heat sink, and having an end cap at each end of the lamp tube;

both ends of the LED tube being providing with a pair of outermost pins; and both ends of the LED tube being provided with a middle or center pin connected to the lamp heat sink;

wherein in the event a failure condition occurs causing electrical current traveling through the LED array to enter the heat sink, such current is safely transferred to ground by at least one of the middle ground pins; and a socket assembly including a pair of outermost pins and a center pin, the LED tube being rotatable in the socket such that the pins contact the outermost pins, at least one of the outermost pins being current carrying, and the center pin contacting a ground plate; the ground plate being connected ground.

4. The system of claim 3 for using an LED tube light to replace a standard fluorescent tube light, wherein the ground plate is connected to a ground strap, the ground strap being connectable to ground.

5. The system of claim 3 for using an LED tube light to replace a standard fluorescent tube light, wherein the ground plate is connected to an angled ground lug, the lug being connectable to ground.

6. The system of claim 3 for using an LED tube light to replace a standard fluorescent tube light, further including an internal ballast in the lamp and an external wiring box, the wiring box having AC line inputs having a wire gauge substantially larger than those of the AC line outputs, the wiring box reducing the gauge of the line outputs to a size sufficiently small to be used with standard T5 and T8 wire input terminals.

7. A socket assembly for use with the tri-pin LED tube of claim 1, having a pair of outermost pins and a middle or center pin, at least one of the outermost pins being current carrying, and the center pin contacting a ground plate; the ground plate being connected to a ground lug, the ground lug being connectable to ground, and wherein the LED tube is rotatable to a locked position so that the outermost pins contact the outermost contacts, and the middle pin contacts the ground plate.

* * * * *